United States Patent [19]

Tanaka et al.

[11] Patent Number: 4,550,560

[45] Date of Patent: Nov. 5, 1985

[54] METHOD FOR PIECING FASCIATED YARN

[75] Inventors: Akira Tanaka, Kariya; Takahiko Tsunekawa, Aichi; Kazuo Seiki, Kariya; Haruyoshi Nakamura, Obu, all of Japan

[73] Assignee: Kabushiki Kaisha Toyoda Jidoshokki Seisakusho, Aichi, Japan

[21] Appl. No.: 593,633

[22] Filed: Mar. 26, 1984

[30] Foreign Application Priority Data

| | | | |
|---|---|---|---|
| Mar. 30, 1983 | [JP] | Japan | 58-52508 |
| Mar. 30, 1983 | [JP] | Japan | 58-52509 |
| Apr. 15, 1983 | [JP] | Japan | 58-65605 |
| Oct. 8, 1983 | [JP] | Japan | 58-187696 |

[51] Int. Cl.[4] ..... D01H 15/00

[52] U.S. Cl. ..... 57/261; 57/22; 57/279

[58] Field of Search ..... 57/22, 261, 279, 280, 57/289, 333, 351

[56] References Cited

U.S. PATENT DOCUMENTS

| | | | |
|---|---|---|---|
| 3,626,440 | 12/1971 | Harmon | 57/261 |
| 3,946,546 | 3/1976 | Venot | 57/280 |
| 3,992,865 | 11/1976 | Tuschida et al. | 57/328 |
| 4,114,358 | 9/1978 | Tsuchida et al. | 57/333 X |

*Primary Examiner*—Donald Watkins

*Attorney, Agent, or Firm*—Burgess, Ryan & Wayne

[57] ABSTRACT

A method for yarn piecing in a fasciated yarn spinning unit, in which an air nozzle for twisting a fiber bundle to form a fasciated yarn is displaced from the normal spinning position to the threading position where the air nozzle can escape from the front roller pair, whereby a free space is prepared for applying a suction means having a sufficient suction force to reversely thread a yarn to be pieced through the air nozzle.

15 Claims, 23 Drawing Figures

METHOD FOR PIECING FASCIATED YARN

BACKGROUND OF THE INVENTION

1. Field of the Invention

The present invention relates to a method for piecing a fasciated yarn. More specifically, it relates to a method for piecing a yarn end to a fiber bundle in a fasciated yarn spinning unit when the yarn breaks during the spinning operation.

2. Description of the Prior Art

In a fasciated yarn spinning unit, a fiber bundle of a ribbon-like shape (hereinafter referred to as a fleece) delivered from a front roller pair of a drafting means is sucked into an air nozzle disposed just downstream of the front roller pair. The fleece is false-twisted in the air nozzle by a vortex generated therein and is converted to a so-called fasciated yarn. This spinning system is very advantageous because it can run at a much higher rate of 100 m/min, compared to a conventional spinning system such as ring spinning or open-end spinning.

A problem has arisen in this spinning system in that the yarn is difficult to be pieced when it has broken during the spinning operation because of the compact structure of the yarn, due to the entanglement of a surface fiber around a core portion of the yarn, as well as the high processing speed it is almost impossible to piece the broken end of the yarn to a freshly delivered fleece by merely superposing them together in the twisting zone. Thus, it is necessary to reversely guide the broken end through the air nozzle into the drafting means so as to superpose it on the fleece in a drafting zone. This is referred to as "threading" hereinafter.

A method for the abovesaid threading operation has been disclosed in, for example, Japanese Unexamined Patent Publication (Kokai) No. 53-35033. According to the prior art method, the air nozzle has inclined jets in an inner wall thereof for reversely transporting the yarn from an outlet to an inlet of the air nozzle by an air stream ejected from the jets. The broken end of the yarn is sucked into the air nozzle from the outlet thereof by the above-mentioned air stream and is exited from the inlet of the air nozzle. Then, it is nipped by a front roller pair of a drafting means. A problem of this prior art method is that the suction force caused by the air stream ejected from the jets is so small that the yarn end disposed in front of the outlet of the air nozzle is difficult to be introduced thereinto or, even if sucked in, it is often prevented from smooth threading due to fluffs.

One solution of the above-mentioned problem is the provision of a suction tube connected to a powerful suction source. A mouth thereof is applied to the inlet of the air nozzle when the yarn piecing operation is carried out to suck the yarn end from the outlet of the air nozzle. However, since the air nozzle in the conventional unit is disposed close to the front roller pair, in order to well receive the fluffy fleece delivered from the latter, there is only a small space therebetween. Accordingly, the mouth of the suction tube has to be small-sized to fit the small space. This causes lack of suction force and, in turn, unsatisfactory threading operation.

SUMMARY OF THE INVENTION

It is an object of the present invention to provide a novel method for yarn piecing in a fasciated yarn spinning system which overcomes the aforesaid drawbacks of the prior art.

It is another object of the present invention to provide a method for yarn piecing in a fasciated yarn spinning unit in which a broken end of a fasciated yarn to be pieced is reversely threaded into an air nozzle by a powerful suction applied to an inlet of the air nozzle.

The above-mentioned objects of the present invention are achievable by providing a method for piecing a yarn in a fasciated yarn spinning unit, this unit comprising a drafting means for delivering a fiber bundle and an air nozzle for receiving the delivered fiber bundle and twisting it therein by a vortex to form a fasciated yarn, comprising the steps of:

a. displacing the air nozzle from the normal spinning position to the threading position where sufficient space exists in front of an inlet of the air nozzle;
b. guiding a yarn to be pieced to an outlet of the air nozzle;
c. applying a suction force through the inlet of the air nozzle to the outlet, whereby the yarn is sucked into the suction means through the air nozzle; and
d. returning the air nozzle from the threading position to the normal spinning position.

The method according to the present invention preferably comprises a step of displacing the suction means away from the inlet of the air nozzle so that a portion of the yarn held in the suction means is exposed in the region between the air nozzle and the suction means prior to the returning step of the air nozzle in step d.

Further, the method preferably comprises a step of guiding the exposed portion of the yarn toward said drafting means together with the step d.

These and other objects of, and many of the advantages of, the present invention will be better understood with reference to the following detailed description taken in connection with the accompanying drawings.

BRIEF DESCRIPTION OF THE DRAWINGS

FIGS. 4A to 4H show steps of a yarn piecing operation according to one aspect of the present invention in which FIGS. 4A and 4B are schematic side views of a fasciated yarn spinning unit and FIGS. 4C to 4H shows plan views thereof;

DESCRIPTION OF THE PREFERRED EMBODIMENTS

Figure 1:
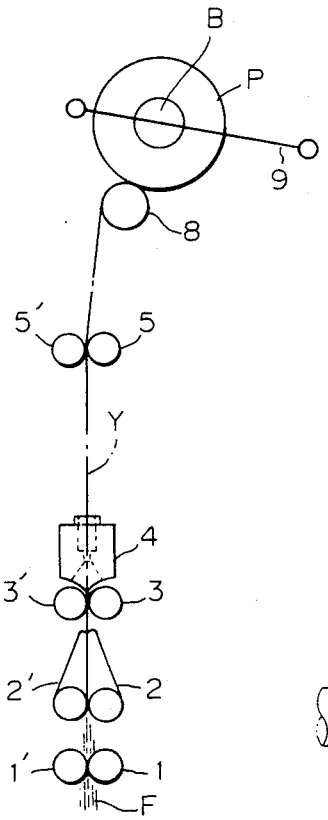
FIG. 1 is a schematic side view of a fasciated yarn spinning unit in operation.

In a fasciated yarn spinning unit shown in FIG. 1, an air nozzle 4 is disposed downstream of a drafting means. The drafting means comprises each pairs of back rollers 1, 1', middle aprons 2, 2', and front rollers 3, 3'. Here, reference numerals 1, 2, and 3 designate bottom side elements positively driven and 1', 2', and 3' designate top side elements driven by the former elements. The drafting means is so devised that the back roller 1 can stop or start irrespective of the other elements 2 and 3 by, for example, a clutch means (not shown). Downstream of the air nozzle 4 are arranged a draw-off roller pair 5, 5' and a take-up drum 8 along a yarn passage. A fiber bundle F fed to the drafting means is attenuated therein at a predetermined drafting ratio and is delivered from the front roller pair 3, 3' as a fleece. The fleece is immediately sucked into the air nozzle 4 through an inlet 4*a* thereof by a suction stream caused by a vortex whirling therein. Passing through the air nozzle 4, the fleece is twisted by the vortex and converted to a fasciated yarn Y. The yarn Y, then, is drawn out from an outlet 4*b* of the air nozzle 4 by the draw-off roller pair 5, 5' and is wound on a bobbin B rotatably supported by an arm 9 and driven by a take-up drum 8. Thus, a yarn package P is formed.

Figure 2:
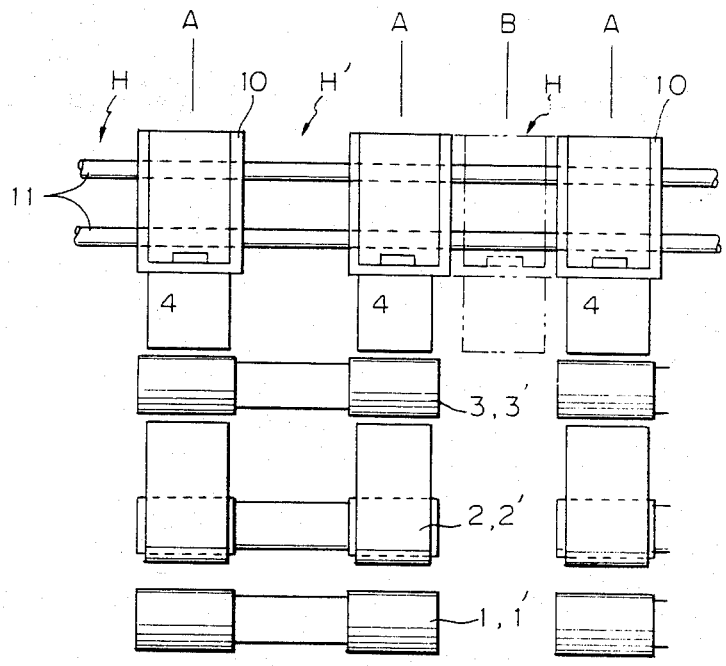
FIG. 2 is a schematic plan view of a group of two fasciated yarn spinning units showing a displaceable air nozzle and a space between two adjacent groups.

The spinning units thus described are arranged on a spinning frame parallel to each other with a predetermined space therebetween. According to the present invention, every adjacent two spinning units form one group having common drafting means so that a free space H is formed between every group, as shown in FIG. 2. The air nozzle 4 is normally disposed in a position A when the spinning operation is carried out. However, when the yarn piecing operation is carried out, it is displaced to a position B within the free space H. According to this displacement, the air nozzle 4 can escape from the position in front of the front roller pair 3, 3', thereby a space sufficient for the piecing operation is prepared.

Figure 3:
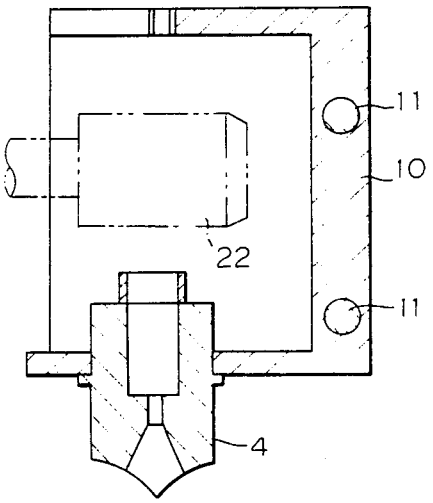
FIG. 3 is a side sectional view of an air nozzle fixed to a holder thereof.

For enhancing this displacement, the air nozzle 4 is provided with a holder 10 on its body. The holder 10 is slidably engaged on two stationary guide rods 11 arranged parallel to an axis of the front pair 3, 3' through apertures provided on side walls of the holder 10, as shown in FIGS. 2 and 3. In FIG. 3, a chain line depicts a position of a piecing roller 22 in the united condition, as described later.

Figure 4A:
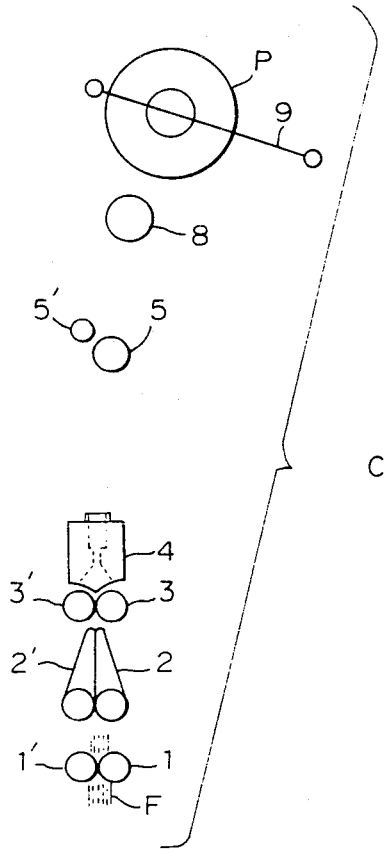

When a yarn breakage occurs during the spinning operation, the package P is detached from the take-up drum 8 by a known push-up mechanism for the arm 9 (not shown). On the other hand, in the drafting means, only the back roller pair 1, 1' is stopped at once while the other pairs 2, 2' and 3, 3' continue to rotate, whereby the fleece F is torn in a drafting zone between the back roller pair 1, 1' and the second apron pair 2, 2' (FIG. 4A).

The yarn breakage signal is transmitted to yarn piecer patrolling around the spinning frame along a rail arranged in front thereof. The yarn piecer stops in front of the faulty unit in a known manner, and the piecing operation then starts.

Figure 4B:
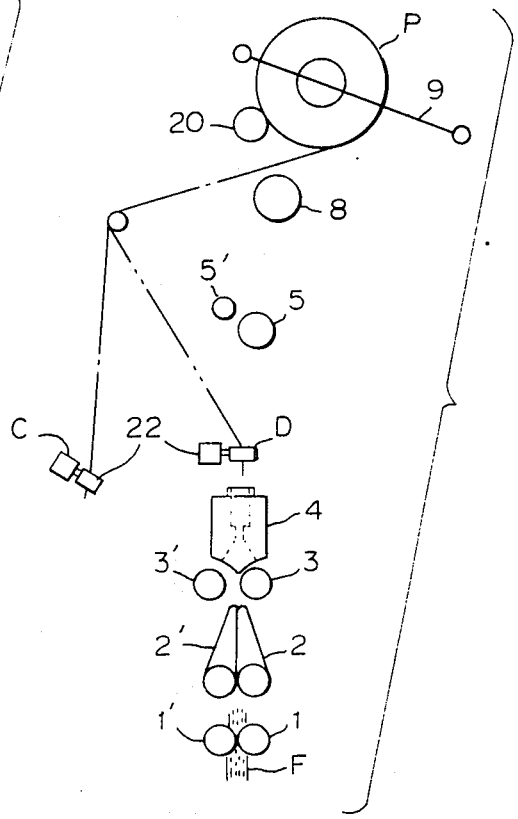
Figure 5:
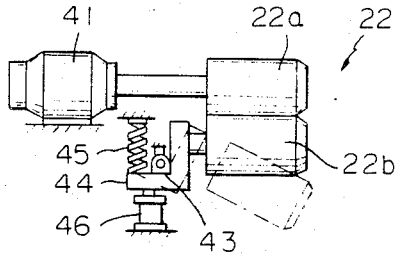
FIG. 5 is a plan view showing a construction of a piecing roller.

The package P detached from the drum 8 is supported by a known package driving roller 20 provided on the yarn piecer, as shown in FIG. 4B. The package driving roller 20 has a function to rotate the package P in the normal or reverse direction. First, the broken end of the yarn is picked up from a package surface with a known pick-up mechanism (not shown) during the reverse rotation of the package P by the package driving roller. Then, the broken end is transferred to a guiding means such as a piecing roller means 22 in a waiting position C and nipped thereby, as shown in FIG. 4B. In FIG. 5, it comprises a driving roller 22*a* connected to a motor 41 and a pressing roller 22*b* rotatably secured on a L-shaped member 44. The L-shaped member 44 is hinged to a frame of the roller means 22 (not shown) by a pin 43 and is biased by a compression spring 45 so that the pressing roller 22*b* is urged onto the driving roller 22*a*. The L-shaped member is also engaged to an actuator of a solenoid 46 to overcome the bias of the spring 45 when the solenoid 46 is energized, and to detach the pressing roller 22*b* from the driving roller 22*a*. According to this structure, the yarn can be inserted into or removed from a gap between the two rollers 22*a* and 22*b* when detached, and can be nipped therebetween when engaged. Under the nipped condition, the yarn can be fed normally or reversely corresponding to the rotational direction of the driving roller 22*a*.

Figure 6:
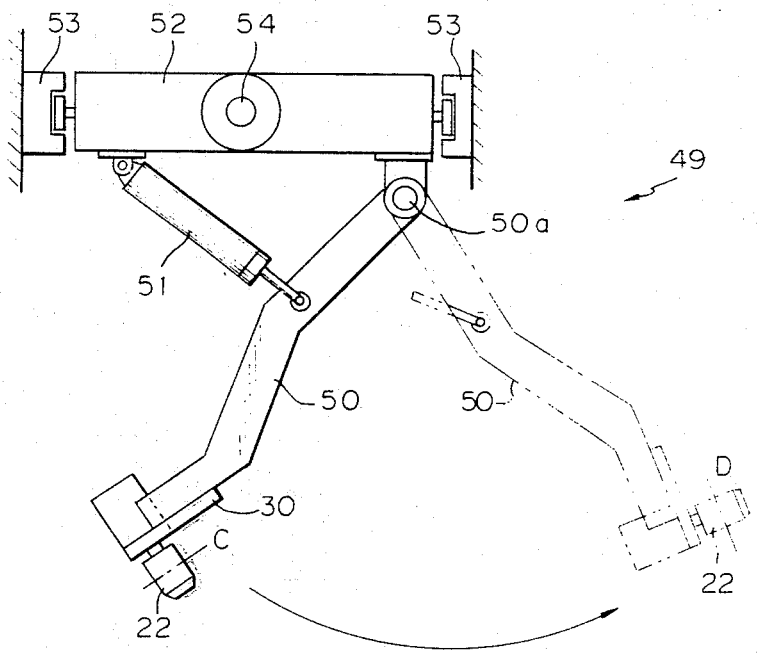
FIG. 6 is a side view of a displacement mechanism for a piecing roller means.

The piecing roller means 22 is mounted on an outer end of an arm 50 of a displacing mechanism 49 secured on the yarn piecer as shown in FIG. 6. The arm 50 can pivot around a pin 50*a* with a predetermined angle by the action of an air cylinder 51, thereby the piecing roller means 22 is displaceable from the above waiting position C to another position D in a plane parallel to the plane of the paper of the drawing at which position the piecing roller means 22 is united to the air nozzle 4 in the normal spinning position A, as stated later. Both the arm 50 and the air cylinder 51 are mounted on a carrier 52 supported by a pair of rails 53 in such a manner that it is movable along the latter by means of an air cylinder 54 in a plane perpendicular to the plane of paper of the drawing. This perpendicular displacement of the carrier 52 causes the aforesaid displacement of the air nozzle 4 from the position A to B.

As described above, the piecing roller means 22 receiving the broken end of the yarn is moved from the waiting position C to the position D corresponding to the position A of the air nozzle 4 as shown in FIG. 4B. At the position D, the piecing roller means 22 meets with the air nozzle 4 and is united one to the other so that the relative position of the two is fixed for facilitating the threading operation.

Figure 7:
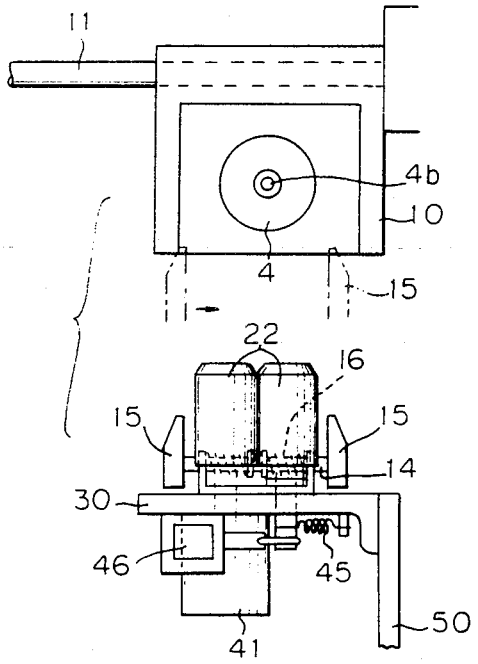
FIGS. 7 and 8 are plan views showing a uniting operation of an air nozzle and a piecing roller means.
Figure 8:
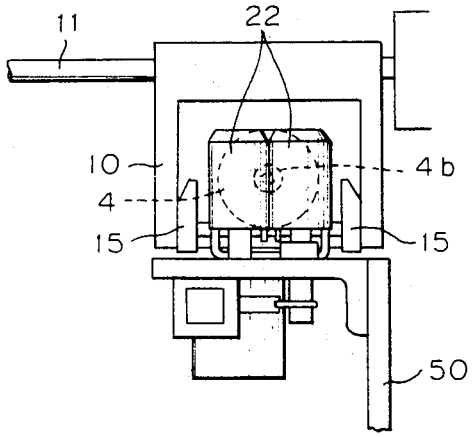

The mechanism for union of the two is described with reference to FIGS. 7 and 8, as follows.

The piecing roller means 22 is provided with a bracket 30 through which a stud 14 is loosely inserted. Positioning members 15, 15 are secured on opposite ends of the stud 14. The distance between the outer edges of both positioning members 15, 15 corresponds to the inner width of the holder 10 of the air nozzle 4. Thus, as shown in FIG. 7, when the piecing roller 22 approaches the air nozzle 4 disposed in the position A, the positioning members 15, 15 are inserted into the holder 10 and are closely engaged with the inner wall of the latter. At the final stage (in FIG. 8), the outlet 4*b* of the air nozzle 4 coincides with a nip line of the piecing roller means 22.

Fluctuation of the relative position of the air nozzle 4 and the piecing roller means causes no problem if it is within a predetermined range, because the positional error can be corrected at the final stage by a tapered structure of the positioning member 15 and a spring 16 supporting the stud 14, so as to allow a lateral movement of the stud 14.

After the union of the piecing roller means 22 with the air nozzle 4, the air nozzle 4 is displaced along the guide rods 11 from the normal spinning position A to the threading position B, according to the mechanism described before. Due to this displacement, the inlet 4*a* of the air nozzle 4 is brought into the free space H.

Figure 4C:
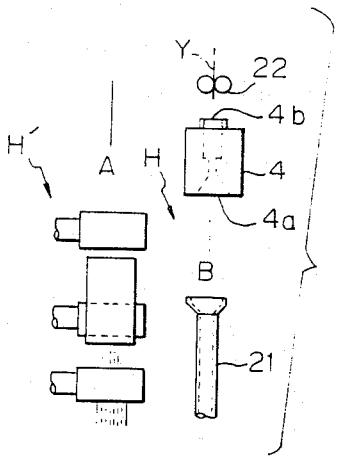

As shown in FIG. 4C, in front of the inlet 4*a* of the air nozzle 4 in this position is disposed a suction means such as a suction tube 21 connected to a suction source (not shown) movable toward the air nozzle 4 from its waiting position along the extension of the nozzle axis. This suction tube 21 can be designed to provide a powerful suction force sufficient to thread the yarn from the outlet 4*b* to the inlet 4*a* of the air nozzle 4, because the size of the tube 21 is not restricted by the parts of the spinning unit.

Figure 4D:
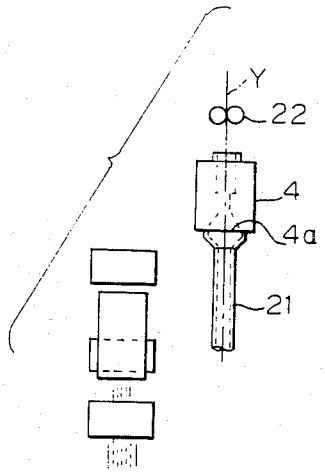

When the suction tube 21 is in close contact with the inlet 4*a* of the air nozzle 4, the piecing roller means 22 is reversely rotated in synchronism with the package driving roller 20, to reversely feed the yarn from the package P. Due to the suction force of the suction tube 21, the yarn from the package P is introduced into the air nozzle 4 and sucked into the suction tube 21 as the reverse rotation of the piecing roller means 22. After the predetermined length of the yarn is reversed in the suction tube 21, the rotation of the piecing roller means 22 and the package roller 20 is stopped (FIG. 4D). It is necessary to control the reverse rotation of the piecing roller means 22 so that an excess length of the yarn is not reserved, in order to facilitate a transferring operation of the yarn from the suction tube 21 to an intermediate yarn holding means, as described later.

Figure 4E:
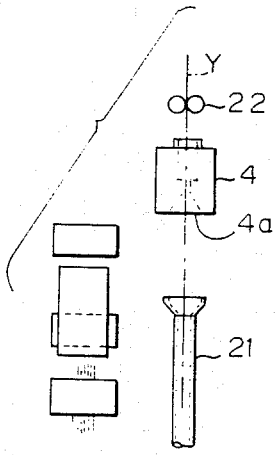

Then, the suction tube 21 moves backward to the waiting position while exposing part of the reserved yarn between a mouth thereof and the inlet 4*a* of the air nozzle 4, as shown in FIG. 4E.

In the vicinity of the exposed yarn, an intermediate yarn holding means such as a yarn holding pipe 28 connected to a suction source (not shown) is arranged on the yarn piecer. The yarn holding pipe 28 is positioned substantially perpendicular to the exposed yarn and is displaceable toward the drafting means of the spinning unit while crossing the exposed yarn. Also, the yarn holding pipe 28 is sized to be small enough to be able to enter into a narrow space in the drafting means.

Figure 4F:
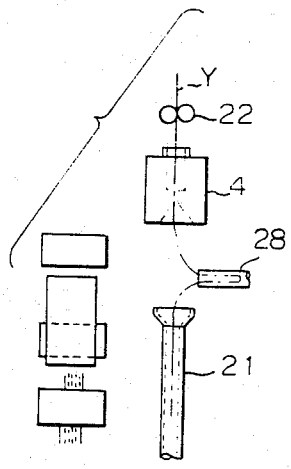
Figure 4G:
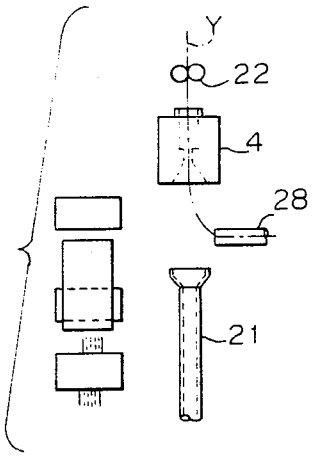

Under such conditions, the yarn holding pipe 28 moves slightly forward to contact the yarn and the midportion of the yarn is sucked into the yarn holding pipe 28 (see FIG. 4F). As the yarn is sucked into the yarn holding tube 28, the reserved yarn in the suction tube 21 is drawn out therefrom. Since the suction force on the yarn is generally proportional to the yarn length, the force of the suction tube 21 is gradually weakened and, contrary to this, that of the yarn holding pipe 28 is gradually strengthened. Thus, the reserved yarn in the suction tube 21 is smoothly and completely transferred to the yarn holding pipe 28, as shown in FIG. 4G, even if the latter is small in size.

Figures 9A, 9B, 9C:
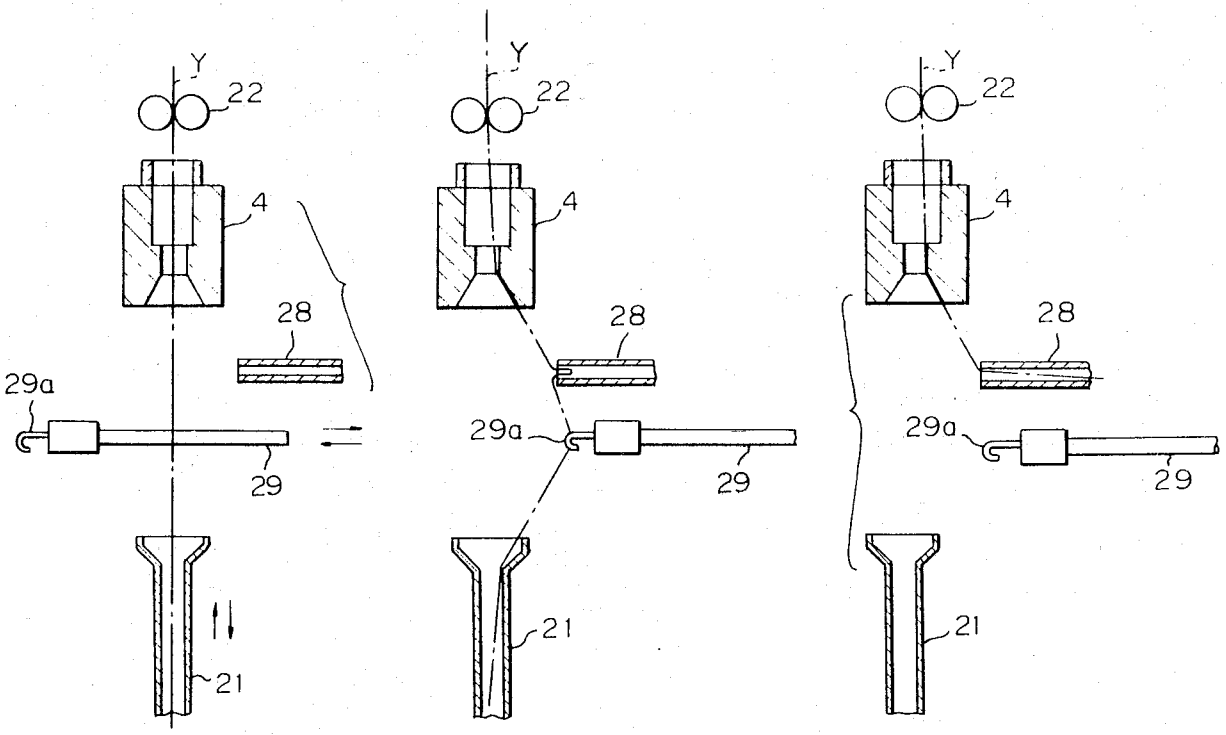
FIGS. 9A to 9C are schematic side sectional views showing steps of another aspect of a yarn piecing operation utilizing a hook member.

According to an alternative aspect of the present invention, in order to enhance the above yarn transferring operation from the suction tube 21 to the yarn holding pipe 28, a hook member 29 may be utilized, as shown in FIGS. 9A to 9C. The hook member 29 is positioned parallel to the yarn holding pipe 28 and is displaceable while crossing the exposed yarn passage between the air nozzle 4 and the suction tube 21 (FIG. 9A). The hook member 29 is engaged with the yarn by its hook 29*a* during the displacement toward the yarn holding pipe 28. Thereby, the midportion of the yarn is surely guided to the yarn holding pipe 28 (FIG. 9B) and the reserved yarn is completely transferred to the yarn holding pipe 28 in the same manner as described above (FIG. 9C).

After the yarn transferring operation has been completed, a further length of the yarn from the package P is fed by the reverse rotation of the piecing roller means 28 into the yarn holding pipe 28. This is necessary for the latter half of the yarn piecing operation.

Figure 4H:
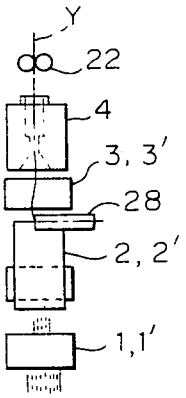

The next step is the insertion of the yarn between a front roller pair 3, 3'. The front roller pair 3, 3' has been kept in a condition by a known means wherein the top side element 3' is detached from the bottom side element 3, as shown in FIG. 4B. The air nozzle 4 now threaded moves back from the threading position B to the normal spinning position A while being united with the piecing roller means 22 by means of the displacing mechanism 49. In synchronism with this returning operation of the air nozzle 4, the yarn holding pipe 28 also moves in the same direction as the movement of the air nozzle 4 toward the drafting means so that the yarn is inserted into the gap between the front roller pair 3, 3', as shown in FIG. 4H.

Thereafter, the back roller pair 1, 1' starts again, and the fiber bundle moves forward. When the leading end of the fleece reaches the front roller pair 3, 3' (this moment can be predetermined by a processing speed of the spinning unit and a length of the drafting means), the top side element 3' of the front roller pair is attached to the bottom side element 3 thereof, thereby the yarn held by the yarn holding pipe 28 is superposed on the fleece under a nip of the front roller pair 3, 3'. At the same time, the high pressure air is fed to the air nozzle 4 for generating a vortex for twisting the fleece and, further, the piecing roller means 22 as well as the packaging driving roller 20 also rotate in the normal direction at a rate corresponding to the speed of the front roller pair 3, 3', so as not to slacken the yarn. According to these operations, the broken ends of the yarn and the fleece are entangled and united one to the other in the air nozzle 4. After the package P attains a normal winding speed, the piecing roller means 22 releases the yarn from its nipping and the package driving roller 20 stops the service for winding the package and assigns it to the take-up drum 8. Thereafter, the piecing roller means 22, package driving roller 20, and the yarn holding pipe 28 return to their original positions, in order to prepare for the next yarn piecing.

Figure 10A:
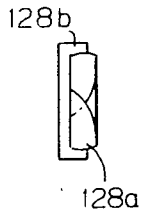
FIGS. 10A and 10B are front and plan views of a movable yarn guide, respectively.
Figure 10B:
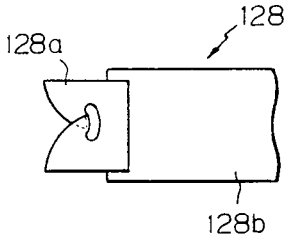
Figure 11A:
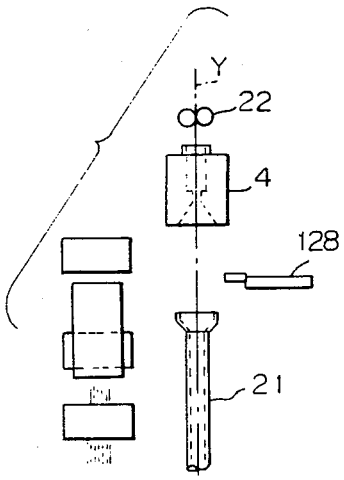
FIGS. 11A and 11B are schematic side views showing steps of a further aspect of a yarn piecing operation utilizing a movable yarn guide.
Figure 11B:
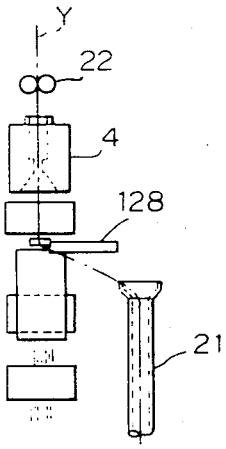

According to another aspect of the present invention shown in FIGS. 10, 11A, and 11B, the yarn transferring operation from the suction tube 21 to the yarn holding pipe 28 shown in FIGS. 4F, 4G, and 9A to 9C can be omitted. That is, in this aspect, a movable yarn guide 128 is utilized instead of the yarn holding pipe 28. The yarn guide 128 has a guide member 128*a* on its front end made of anti-abrasive material such as ceramic, as shown in FIG. 10. The yarn guide is displaceable toward the drafting means across the yarn held by the suction tube 21. Corresponding to the returning movement of the air nozzle 4 from the position B to A after the yarn is threaded, the yarn guide 128 displaces laterally toward the drafting means. On the way, it catches the yarn with the guide member 128*a* and brings it into the drafting means, as shown in FIGS. 11A and 11B.

Figure 12:
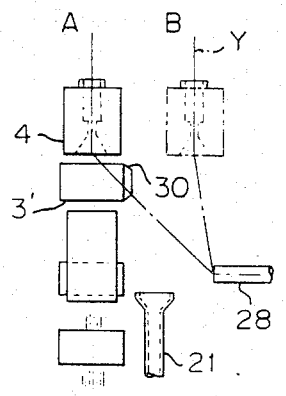
FIG. 12 is a similar view as shown in FIGS. 4C to 4H showing a step of a yet further aspect of the present invention.

In the yarn piecing operation described hereinbefore, the top side element 3' of the front roller pair is initially detached from the bottom element 3 so as to provide a gap therebetween for inserting the yarn. However, the front roller pair 3, 3' may be kept in the engaged state during the yarn piecing operation if the top side element 3' is formed to have a chamferred end 30, as shown in FIG. 12. This is because the yarn can be automatically inserted (nipped) between the front roller pair 3, 3' so long as it comes in contact with the chamferred end 30 of the rotating front side element 3'.

Also, the displacement of the air nozzle is not limited to that parallel to the axis of the front roller pair as stated above but may be carried out in the direction perpendicular to the axis of the front roller pair. Further, instead of the piecing roller means, a suction means can be utilized as a guiding means.

As stated above, according to the present invention, since the air nozzle is displaced from the normal spinning position where it confronts the front roller to the threading position free from the front roller at the time of yarn piecing, it is possible to provide a free space for disposing a powerful suction means in front of the inlet of the air nozzle and, thereby, effective threading through the air nozzle can be achieved.

Further, according to the present invention the guiding means for carrying the yarn having been threaded into the drafting means is prepared separately from the suction means for threading. So, the former can be made small enough for matching the narrow space in the drafting means. This enhances a sure disposition of the yarn to be pieced in the drafting means and improves the possibility of success in the piecing operation.

We claim:

1. A method for piecing a yarn in a fasciated yarn spinning unit, said unit comprising a drafting means for delivering a fiber bundle and an air nozzle for receiving said delivered fiber bundle and twisting it therein by a vortex to form a fasciated yarn, comprising steps of:

a1. stopping said delivery of said fiber bundle to said air nozzle;

a. displacing said air nozzle from a normal spinning position to a threading position such that a space exists in front of an inlet of said air nozzle;

b. guiding a yarn to be pieced to an outlet of said air nozzle;

c. applying a suction force through said inlet of said air nozzle to said outlet by a displaceable suction means, whereby the yarn is sucked into said suction means through said air nozzle;

d. returning said air nozzle from the threading position to the normal spinning position; and e. resuming the delivery of said fiber bundle to said air nozzle, whereby said fiber bundle and said yarn to be pieced are united.

2. A method according to claim 1, further comprising, between steps c and d, a step of:

c-1. displacing said suction means away from said inlet of said air nozzle so that a portion of the yarn sucked and held in said suction means is exposed in the region between said air nozzle and said suction means.

3. A method according to claim 2, further comprising, between steps c-1 and d, a step of:

c-2. transferring the yarn held in said suction means therefrom to an intermediate yarn holding means.

4. A method according to claim 3, further comprising, between steps c-2 and d, a step;

c-3. feeding a further length of yarn into said intermediate yarn holding means.

5. A method for piecing a yarn in a fasciated yarn spinning unit, said unit comprising a drafting means for delivering a fiber bundle and an air nozzle for receiving said delivered fiber bundle and twisting it therein by a vortex to form a fasciated yarn, comprising steps of:

a1. stopping said delivery of said fiber bundle to said air nozzle;

a. displacing said air nozzle from a normal spinning position to a threading position such that a space exists in front of an inlet of said air nozzle;

b. guiding a yarn to be pieced to an outlet of said air nozzle;

c. applying a suction force through said inlet of said air nozzle to said outlet by a displaceable suction means, whereby the yarn is sucked into said suction means through said air nozzle;

d. displacing said suction means away from said inlet of air nozzle so that a portion of the yarn sucked and held in said suction means is exposed in the region between said air nozzle and said suction means;

e. returning said air nozzle from the threading position to the normal spinning position while guiding the exposed portion of the yarn toward said drafting means; and f. resuming the delivery of said fiber bundle to said air nozzle, whereby said fiber bundle and said yarn to be pieced are united.

6. A method according to claim 5, further comprising, between steps d and e, a step of:

d-1. transferring the yarn held in said suction means therefrom to an intermediate yarn holding means.

7. A method according to claim 5, in which said guiding operation of the yarn toward said drafting means in step e is carried out by a movable yarn guide.

8. A method according to claim 6, in which said guiding operation of the yarn toward said drafting means in step e is carried out by said intermediate yarn holding means.

9. A method according to claim 8, in which said intermediate yarn holding means is a suction pipe having a small size to match with a narrow space in the drafting means.

10. A method according to claim 3, in which said transferring operation of the yarn from said suction means to said intermediate yarn holding means is enhanced by guiding the midportion of the exposed yarn toward said intermediate yarn holding means by a movable hook member.

11. In a fasciated yarn spinning apparatus of the type including drafting means for supplying a fiber bundle and an air nozzle having an outlet and an inlet receiving the supplied fiber bundle, the air nozzle twisting the fiber bundle therein by a vortex to form a fasciated yarn, a device for piecing together yarn comprising:

a. displacing means for moving said air nozzle between a normal spinning position and a threading position such that a space exists in front of the inlet of said air nozzle; and b. displaceable suction means for applying a suction force through said inlet of said nozzle to suck the yarn from the outlet of said air nozzle, when said air nozzle is moved to said threading position.

12. A device according to claim 11, wherein said suction means is displaceable between a first position at the inlet of said air nozzle and a second position away from said inlet, when said air nozzle is moved to said threaded position, so that a portion of the yarn sucked and held in said suction means is exposed in a region between said air nozzle and said suction means in said second position.

13. A device according to claim 11, further comprising intermediate yarn holding means to which the yarn held in said suction means is transferred.

14. A device according to claim 13, wherein said intermediate yarn holding means is a suction pipe having a small size to match a narrow space in the drafting means.

15. A device according to claim 13, further comprising a movable hook member for guiding a midportion of exposed yarn toward said intermediate yarn holding means for enhancing the transfer of said yarn from said suction means to said intermediate yarn holding means.

* * * * *